United States Patent [19]

Stelfox et al.

[11] Patent Number: 5,034,868

[45] Date of Patent: Jul. 23, 1991

[54] ELECTRIC LUMINARIA FIXTURE

[75] Inventors: Sallie Stelfox; Joyce N. Hannaum, both of Corrales, N. Mex.; A. Duane Kirkwood, El Paso, Tex.

[73] Assignee: Casa Noel, Ltd., Corrales, N. Mex.

[21] Appl. No.: 431,560

[22] Filed: Nov. 3, 1989

[51] Int. Cl.[5] ..... F21V 21/00

[52] U.S. Cl. ..... 362/352; 362/410; 362/806

[58] Field of Search ..... 362/156, 311, 351, 352, 362/382, 388, 458, 806, 410

[56] References Cited

U.S. PATENT DOCUMENTS

| | | | |
|---|---|---|---|
| 2,516,866 | 8/1950 | Halpern | 362/388 |
| 2,542,361 | 2/1951 | Roxburgh | 362/806 |
| 2,714,652 | 8/1955 | Meyer | 362/806 |
| 4,117,533 | 9/1978 | Hagelthorn | 362/806 |
| 4,562,521 | 12/1985 | Noguchi | 362/352 |

OTHER PUBLICATIONS

Publication of R. C. Company for Festive-Lites TM, no date.

Publications (Assembly instructions and advertisement) of R. C. Company for Electric Luminarias TM, no date.

*Primary Examiner*—Ira S. Lazarus

*Assistant Examiner*—Richard R. Cole

*Attorney, Agent, or Firm*—Deborah A. Peacock; William A. Eklund; Donovan F. Duggan

[57] ABSTRACT

The disclosure is directed to an electric luminaria fixture. The fixture comprises a frame and associated legs, which support an electric lamp inside a bag to give the appearance of a traditional luminaria. The frame includes a semicircular clip which is adapted to support and retain lamp sockets of various sizes and shapes. The legs of the fixture include rotatable feet which can be nailed to a surface, and clips which attach the bag to the fixture. The fixture is preferably used with an inverted bag, to allow electrical wiring to extend unimpeded beneath the luminaria.

34 Claims, 4 Drawing Sheets

ELECTRIC LUMINARIA FIXTURE

BACKGROUND OF THE INVENTION

1. Field of the Invention.

The invention described and claimed herein is generally related to lighting fixtures. More particularly, the present invention is related to luminarias.

There is a traditional Hispanic custom, practiced in the State of New Mexico and elsewhere, of placing candles in small paper bags to form decorative outdoor Christmas holiday lights. Such lights are called luminarias, and are occasionally also referred to as farolitos. They are traditionally prepared in substantial numbers, typically a few tens or even a hundred or more, and placed in rows along sidewalks or driveways, where they are lit at night. They are also placed along the edges of rooftops, along porches or balconies, and in various other outdoor locations. A small amount of sand, or a brick, is typically placed in the bottom of each bag, to weight the bag and prevent it from being blown over by the wind. The sand, or brick, also functions as a fireproof support for the candle. The top of the bag is frequently folded over to form a cuff for additional stability.

2. Description Of Related Art Including Information Disclosed Under 37 CFR 1.97-1.99

In recent years electric luminarias have begun to replace traditional luminarias, for several reasons. First, traditional luminarias, despite the precaution of using sand or bricks to stabilize the bag and support the candle, can occasionally catch fire and thereby form a potential fire hazard, particularly in windy conditions. Also, traditional luminarias require considerable time and effort to prepare and deploy. Each candle must be lit by hand, which is awkward because the candle must be either lit while inside the confines of the bag, or alternatively must be lit while outside the bag and then carefully placed inside the bag. Moreover, each luminaria is typically lit every night over a period of at least several nights during the Christmas holiday season. Finally, a moderate wind or a rainstorm can disturb and extinguish traditional luminarias, necessitating they be manually re-lit during the dark hours of the evening.

The electric luminarias available to date typically consist of strings of spaced electric lights, similar or identical to the commonly available strings of outdoor Christmas lights. The lights are adapted to be placed in either traditional paper bags or special plastic bags or sleeves which are produced for this purpose.

At least one fixture has been previously available in the prior art for supporting electric lights in a paper or plastic bag. This prior art fixture is illustrated in FIG. 7. This prior art fixture suffers from certain disadvantages. For example, it does not allow for uniform illumination of the bag; it does not accommodate lamp sockets of widely varying sizes and shapes; it does not retain the bag in windy conditions; and it is not easily affixed to a supporting surface for stability. Details of the structure and function of this prior art fixture are discussed below in relation to the structure and function of the present invention.

SUMMARY OF THE INVENTION

There is provided herein an electric luminaria fixture, for supporting an electric lamp within an enclosing bag, comprising a generally rectangular planar one-piece frame sized to be positioned horizontally inside the bag, and further comprising a plurality of spaced openings to allow light radiated from a lamp mounted on the frame to illuminate the bag uniformly above and below the level of the frame, to dissipate heat from the lamp and to provide for ease in assembly of the fixture. The frame preferably comprises a central socket opening for supporting and retaining a lamp socket and a socket clip structure for retaining the lamp socket within the central socket opening. The socket clip structure further preferably comprises an arcuate member pivotably mounted to the frame so as to swing horizontally over the socket opening, whereby the arcuate member is operable to retain the lamp socket within the central socket opening. The fixture further comprises legs for supporting the frame so as to space the frame above an underlying supporting surface. The arcuate member of the preferred fixture is operable to at least partially encircle the lamp socket within the central socket opening to retain the lamp socket within the central socket opening, but may substantially completely encircle the lamp socket, depending on the size of the socket. The arcuate member is further operable to urge the lamp socket against the opposite side of the central socket opening to retain the lamp socket within the central socket opening. The arcuate member of the electric luminaria fixture further comprises an integral pivot pin, which may be engaged within a cooperating bore formed in the frame adjacent the socket opening, wherein the pivot pin is snugly fitted so as to provide frictional resistance to rotation, and the arcuate member is selectively positionable to retain the lamp socket in the central socket opening.

The legs of the preferred electric luminaria fixture are devoid of cross bar means and are removably attachable to the planar frame. The legs are further preferably generally cylindrical in cross section, at least where attached to the frame, so as to be rotatable and snap fittable into recesses formed in the planar frame.

The legs of the electric luminaria fixture preferably comprise bags stabilizing upright extensions which extend upwardly above the planar frame so as to stabilize the bag positioned over the frame, thus inhibiting the bag from undergoing distortion. The upright leg extensions further comprise rounded upper ends to ease guiding the bag onto the fixture, stabilize the bag, and prevent tearing of the bag. The legs preferably comprise structure for securing the bag to the legs and preferably further comprise integral, outwardly extendable feet, having a slot structure for placement of fasteners to secure the legs to the underlying support surface, which slots are positionable to face outwardly from the legs and frame to facilitate driving of fasteners into the slots. The bag securing structure may further comprise integral clips or tab clamp structure on the legs for securing the bag to the legs.

The fixture is preferably used with a bag inverted upside down and placed over the fixture, with the bottom of the bag being opened up so as to give the appearance of a traditional luminaria. This avoids the need to cut holes in the bag for electrical wiring to pass through. Also, this allows the electrical wiring beneath the fixture to be unimpeded by the bag, and to be oriented to extend in any direction from the bag after the luminaria has been deployed.

Accordingly, it is an object and purpose of the present invention to provide an improved electric luminaria fixture that operates to support an electric lamp inside a bag.

More specifically, it is an object and purpose of the present invention to provide an electric luminaria fixture that supports a variety of differently sized and shaped lamp sockets, and which allows a string of holiday lamps to be incorporated into a plurality of bags with a minimum of effort.

One advantage of the present invention is that it provides an electric luminaria fixture with removable legs, thus making the fixtures easily assembleable, disassembleable, and convenient to store.

Another advantage of the present invention is that it provides an electric luminaria fixture which produces substantially uniform illumination throughout the interior of a bag in which the fixture is located.

Still another object of the present invention is to provide an electric luminaria fixture that provides ease of assembly in terms of placing the bag on the frame and a securing structure to secure the bag to the frame.

It is yet another object of the present invention to provide an electric luminaria fixture which can be readily affixed to a supporting surface.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

DESCRIPTION OF THE PREFERRED EMBODIMENT

Figure 1:
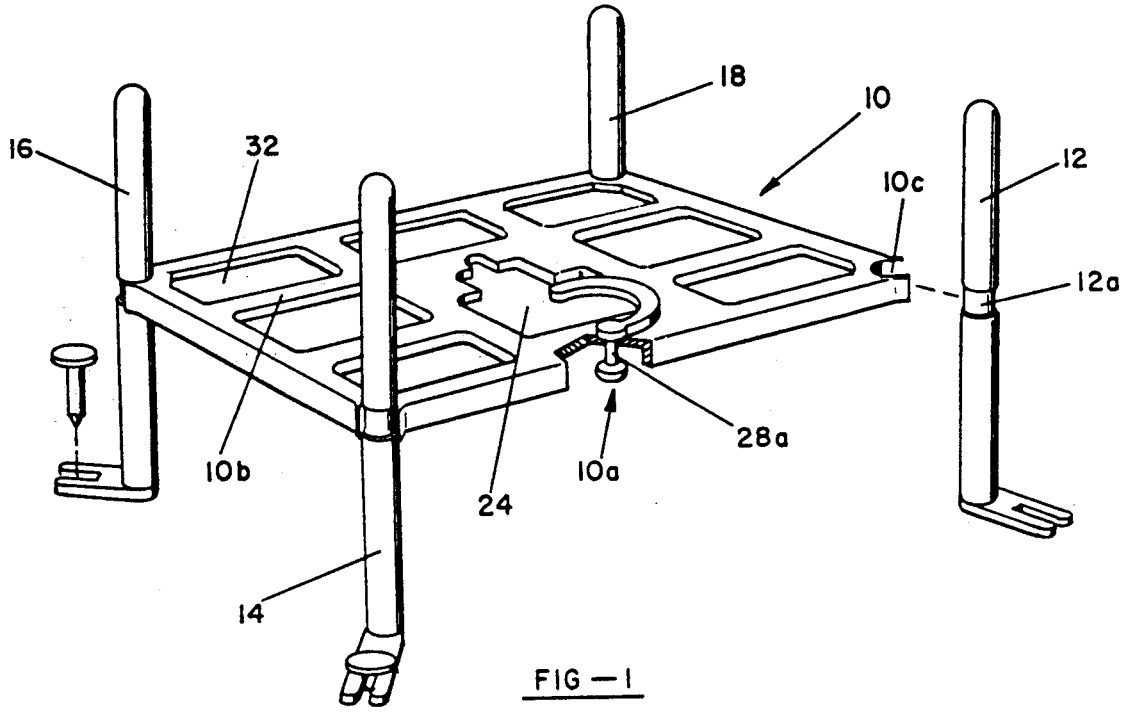
FIG. 1 is an isometric view of the preferred embodiment of the electric luminaria fixture of the present invention.

A preferred embodiment of the electric luminaria fixture of the present invention is illustrated in FIGS. 1 through 4. The fixture comprises a generally rectangular, horizontally extending one-piece planar frame 10, which is attached at its four corners to four detachable upright legs 12, 14, 16 and 18. The planar frame 10 of the preferred embodiment is of one-piece construction, further comprising a plurality of spaced openings 32 separated by stringers **10*b*, as shown in the FIG. 1 embodiment. The openings 32 allow light from the lamp to radiate downwardly as well as upwardly from the lamp within the frame 10, thereby illuminating the surrounding bag uniformly. These openings 32 also function to allow air to circulate throughout the bag for dissipating heat from the lamp. The removably positionable legs 12, 14, 16, and 18 permit placement of the fixture of the invention on flat as well as uneven surfaces. Leg 12 of FIG. 1 further illustrates the manner in which the generally cylindrical legs of the fixture may be snap fittable into recesses formed in the planar frame 10 and further permitting rotation of the leg 12 relative to the surface upon which the fixture will be displayed. The four upright legs 12, 14, 16, and 18** are substantially identical to one another, and will be described hereinafter in more detail by reference to one or more of the legs.

Figure 2:
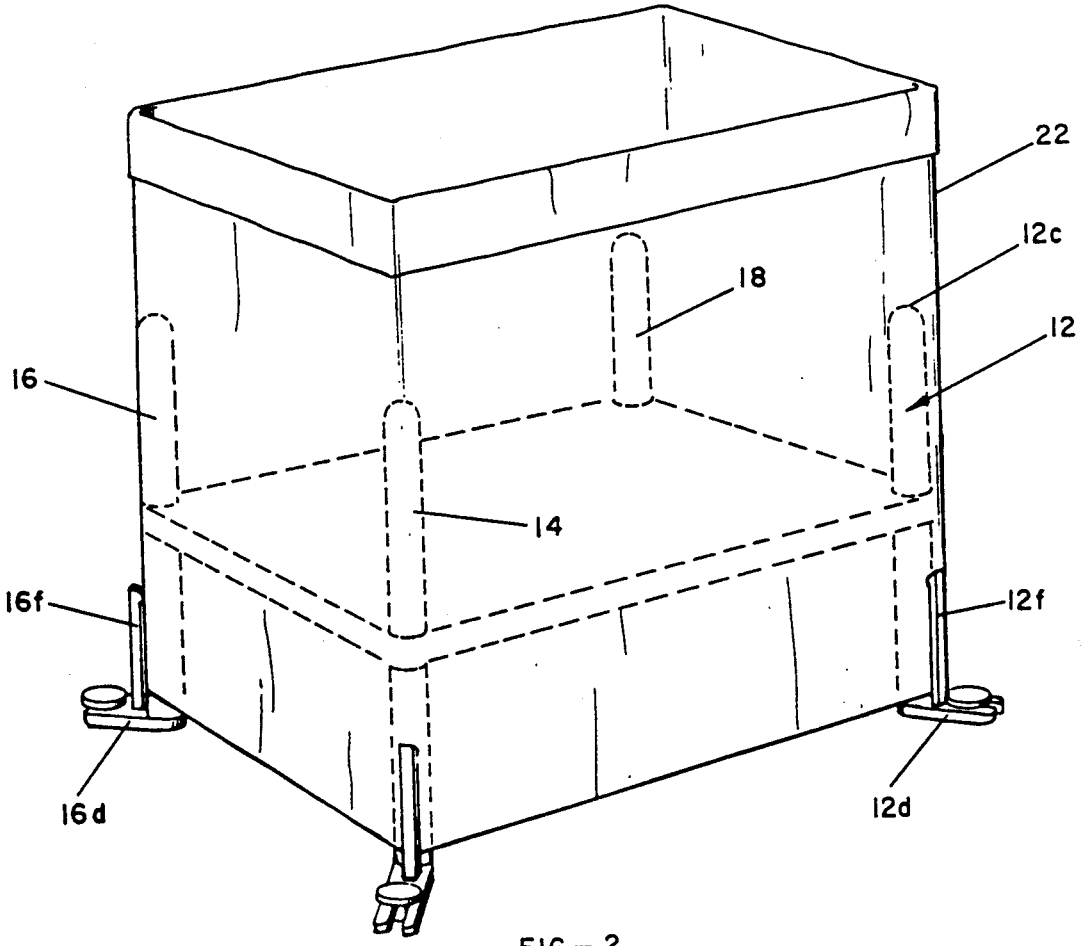
FIG. 2 is an illustration of the fixture of FIG. 1, as it is used in combination with a bag placed over the fixture.
Figure 3:
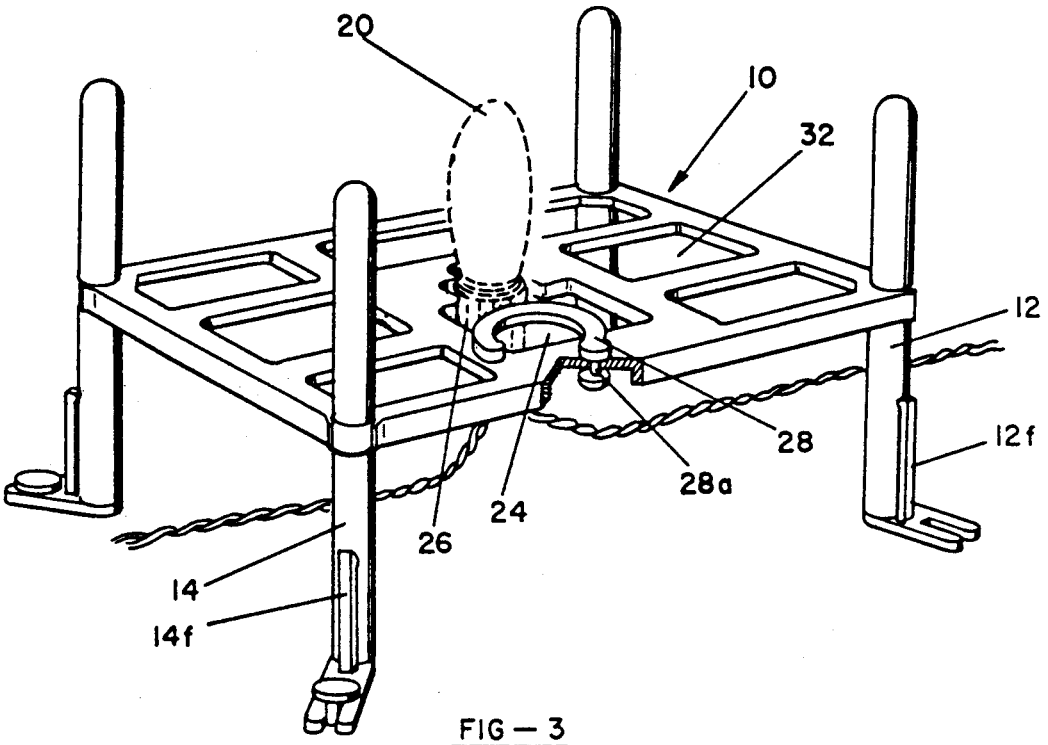
FIG. 3 is an illustration of the fixture of FIG. 1, with a holiday lamp inserted in the frame of the fixture.
Figure 4:
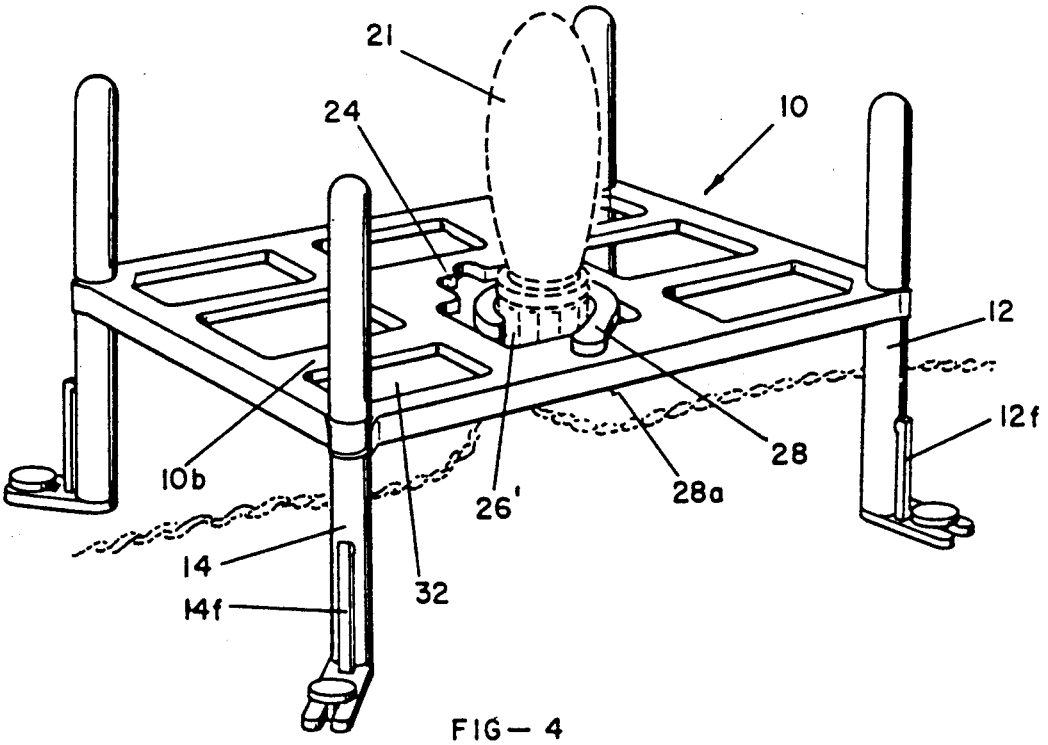
FIG. 4 is an illustration of the fixture of FIG. 1, with a differently sized holiday lamp socket mounted in the frame of the fixture.

Briefly, as shown in FIGS. 3 and 4, and as described in further detail below, the frame 10 supports an electric lamp 20 and 21 and associated lamp socket 26. In use, a bag 22 is placed over the frame 10 and the lamp 20 and 21, as shown in FIG. 2, to form a complete electric luminaria. The preferred embodiment of frame 10 is generally planar and comprises a central socket opening 24 which is sized and shaped to receive electric lamp sockets of varying sizes and shapes. As shown in FIG. 3, the opening 24 receives a lamp socket 26 that is typical of the commonly available strings of holiday lamps. A resilient, arcuate socket clip 28 is pivotably attached to the edge of the frame 10 adjacent the opening 24, and is oriented to swing in a horizontal plane over the opening 24. The socket clip 28 includes an integral, downwardly extending pivot pin **28*a*, which is inserted in a cooperating bore 10*a* formed in the edge of the frame 10, as shown in the cutaway portion of FIG. 1. The pivot pin 28*a* of clip 28 is sized so as to form a tight fit in the bore 10*a*, so that there is frictional resistance to rotation of the pin 28*a* in the cooperating bore 10*a*. This allows the clip 28 to be selectively positioned in the manner shown in FIG. 3, so as to resiliently urge the socket 26 against the opposite edge of the opening 24. Similarly, smaller sockets may be retained by the socket clip 28 extending against the socket, and with the socket clip 28 being positioned so as to resiliently urge the socket against the edge of the frame opening 24**.

The frame 10 can accommodate smaller lamp sockets 26, such as shown in FIG. 3, or larger lamp sockets 26', such as shown in FIG. 4. In FIG. 4 the socket clip 28 extends around a socket 26 which may be either larger or smaller than the smaller socket 26 shown in FIG. 3. Arcuate socket clip 28 may be pivoted in a counterclockwise direction toward the outside edge of frame 10 to partially, substantially, or completely encircle the larger lamp socket 26' of FIG. 4, operating as an enclosing force to secure lamp 21 within opening 24 of frame 10 of the fixture. Larger and smaller sockets within approximately the diameter of arcuate socket clip 28, may be retained in place primarily by the socket clip 28 snugly encircling the socket. As may be appreciated by one skilled in the art, arcuate clip 28 may completely encircle or partially encircle a lamp socket, as well as may extend partially rotated toward the interior edge of opening 24 or substantially away from the inside edge of opening 24.

Figure 5:
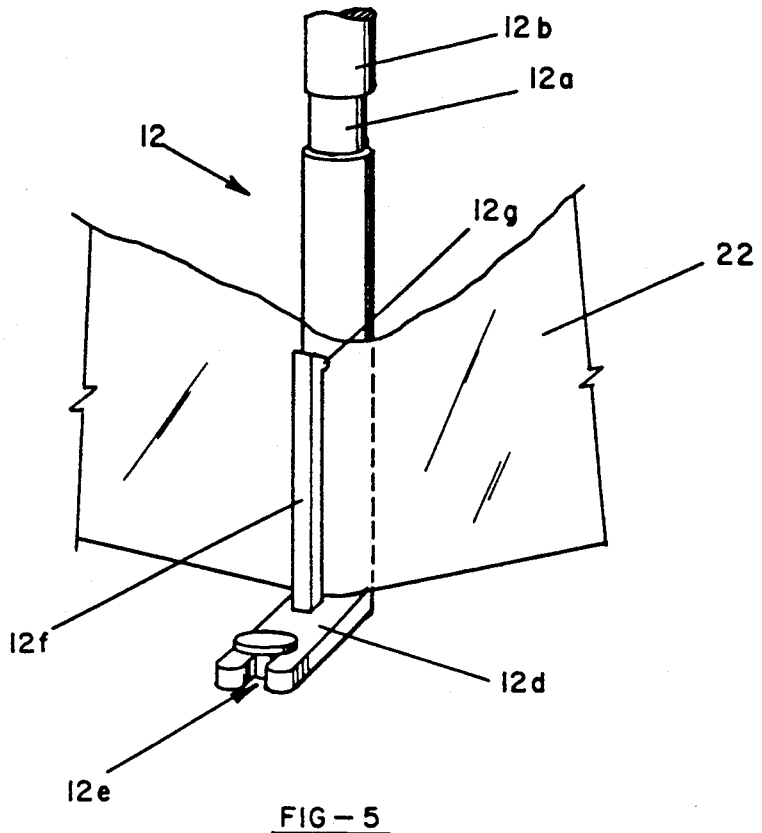
FIG. 5 is an exploded isometric view of the leg of the FIG. 1 embodiment showing a clip securing structure and showing the relation between the bag, the leg, and the clip securing structure.

The legs 12, 14, 16, and 18 may be selectively attached and detached from the frame 10, for example to facilitate packaging during shipping, and to facilitate compact storage of a number of fixtures. Referring to FIG. 5, each leg, for example leg 12, is preferably generally cylindrical in shape. The leg 12 includes a cylindrical midsection segment 12*a* of reduced diameter, which is snap fittable into a cooperably shaped cylindrical recess 10*c* formed in each of the four corners of the frame 10 shown in FIG. 1.

Each leg, for example leg 12, further comprises an upwardly extending extension 12*b*, which serves to stabilize the shape of the bag 22, and a spherically rounded upper end 12*c* which operates to inhibit tearing of the fixture enclosing bag 22 and to facilitate insertion of the frame 10 and legs 12, 14, 16, and 18 into bag 22. In practice, a bag, such as made of plastic or paper, may be provided for use with the instant invention. Such a bag 22 may be sized to snugly slip over the extension 12*b* of leg 12, utilizing the rounded leg end 12*c*, and the respective components of each of the other legs of frame 10, as shown in FIG. 2.

Figure 6:
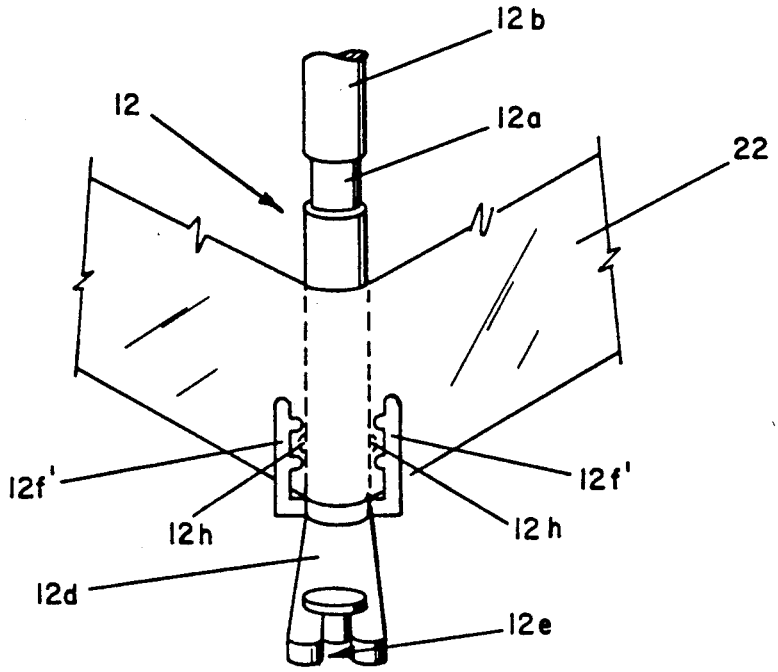
FIG. 6 is an exploded view of the preferred clamp securing structure of the frame leg of the FIG. 1 embodiment.

Each leg, for example leg 12, preferably comprises a foot 12*d*, as shown in FIGS. 1–6, and more particularly FIGS. 5 and 6, which serves to stabilize the fixture on the ground, or other supporting surface. The foot 12*d* of the preferred embodiment further comprises a slot 12*e* positionable to face outwardly from the leg and frame, which permits outwardly extendable foot 12*d* to be fastened to a supporting surface, using a substantially straight, rod-like fastener, such as a tack, nail, peg, pin, staple, or other fastener, so as to stabilize the bag 22 and fixture against unsettling conditions, such as pedestrian movement, condition of the surface upon which the fixture sits, or wind, rain, snow and other uncontrolled conditions. Foot 12*d* can be placed in any desired orientation on an uneven surface, or so that it can be fastened in any desired position. An assembled fixture so fastened, using a broad headed tack, is shown in FIG. 2. The slot 12*e* is preferably spaced outwardly at a small distance from the leg 12 so as to facilitate placement of a fastener into the slot 12*c* or upon foot 12*d*, as would occur when using staples, without interference with the leg 12. Further, the outwardly extendable foot 12*d* and slot 12*e* thereof may be sized to adequately permit such fastening structures. Also, the foot 12*d* may be rotatable with respect to the leg 12.

Each leg, for example leg 12, further preferably comprises means to engage the bag 22 preferably at its edge and prevents the bag from being lifted off of the fixture by environmental conditions such as wind gusts. One engaging means is a resilient clip 12*f*, such as shown in FIG. 5 Clip 12*f* may be constructed of the same material of fixture 10, as part of the same molding process. As shown in FIG. 5, clip 12*f* is preferably positioned so as not to interfere with utilization of foot 12*d* or slot 12*e* when securing fixture 10 to its surface of placement. Clip 12*f* comprises a single upwardly extending clip positioned on each leg to conveniently allow securing and stabilizing of bag 22 without interfering with slot 12*e* on foot 12*d* and permitting fastening of bag 22 by a clamping action on the leg. The clip 12*f* further comprises lobe 12*g*, positioned somewhat above the base of clip 12*f*, yet somewhat below the uppermost tip of clip 12*f*. Lobe 12*g* is further preferably positioned so as to face the leg of which it is a part, thereby creating retaining force to hold bag 22 between clip 12*f* and the leg 12. The portion of the leg 12 facing the surface of clip 12*f* may be flat, acting as a retaining force against the frame leg of which it is a part. Similarly, clip 12*f* may comprise a lobe, described above, and the corresponding portion of the leg 12 may comprise a groove or recessed portion within which lobe 12*g* may rest.

In the preferred embodiment, clip 12*f* may comprise a multiple tab arrangement, such as shown in FIG. 6, wherein clip 12*f* comprises one or more extensions, of substantially the same height. Such a clip with multiple extensions would further secure bag 22 against displacement. Such multiple tabs and corresponding legs may further comprise the lobes, projections, grooves, or extensions described above in combination or singly to work in concert to provide retention of the bag with respect to the fixture. As may be evident to one skilled in the art, the bag retaining clip may comprise any number of extensions or further may be constructed as to be rotatable on the leg of the fixture offering still further flexibility of movement of the leg of fixture, as the preferred embodiment of the leg is rotatable in the frame recess.

As may be apparent, a clip may comprise one or any combination of lobes, grooves, projections, or extensions for the purpose of creating snug retention of the fixture's bag. Similarly, the frame leg may comprise any combination of corresponding projections, lobes, indentations, or grooves for receiving and retaining the fixture's bag. The one-piece frame and one-piece construction of the legs, foot, and clip may be made of any suitable material, although an injection molded polymer such as polystyrene is preferred.

In use, the electric luminaria fixture is attached to an electric lamp utilizing the arcuate clip of the invention in the manner described above, which lamp may typically be one in a string of lamps. A bag is placed upside down over the fixture and the lamp. Traditional paper bags may be used, or plastic bags designed particularly for the purpose may be used. The fixture is preferably sized to snugly receive a paper bag of a commonly available size, for example brown paper bags commonly used for lunches, which have been traditionally widely used for luminarias. It will be appreciated that placing the bag upside down over the fixture allows the electrical wires running to the lamp socket, which typically extend in opposite directions from the bottom of the fixture toward other immediately adjacent luminarias, to extend beneath the edges of the bag without interference from the bag. Additionally, placing the bag upside down over the fixture avoids the necessity of forming holes in the bag through which the wires can pass, which is necessary if the fixture is placed into a bag oriented right side up. Further, the wires can be moved to extend in any direction from the luminaria, as for example when a string of luminarias are positioned in other than a straight line relative to one another or must be moved to a different position. After the bag is placed upside down over the fixture, the resulting top may be trimmed, such as with flat edged scissors, seamstress pinking shears, or a knife edge, so as to create an open top of the luminaria. The cut edges may further be cuffed over by folding the edge against itself, as in the traditional manner of constructing luminarias using paper sacks, sand, and candle.

Figure 7:
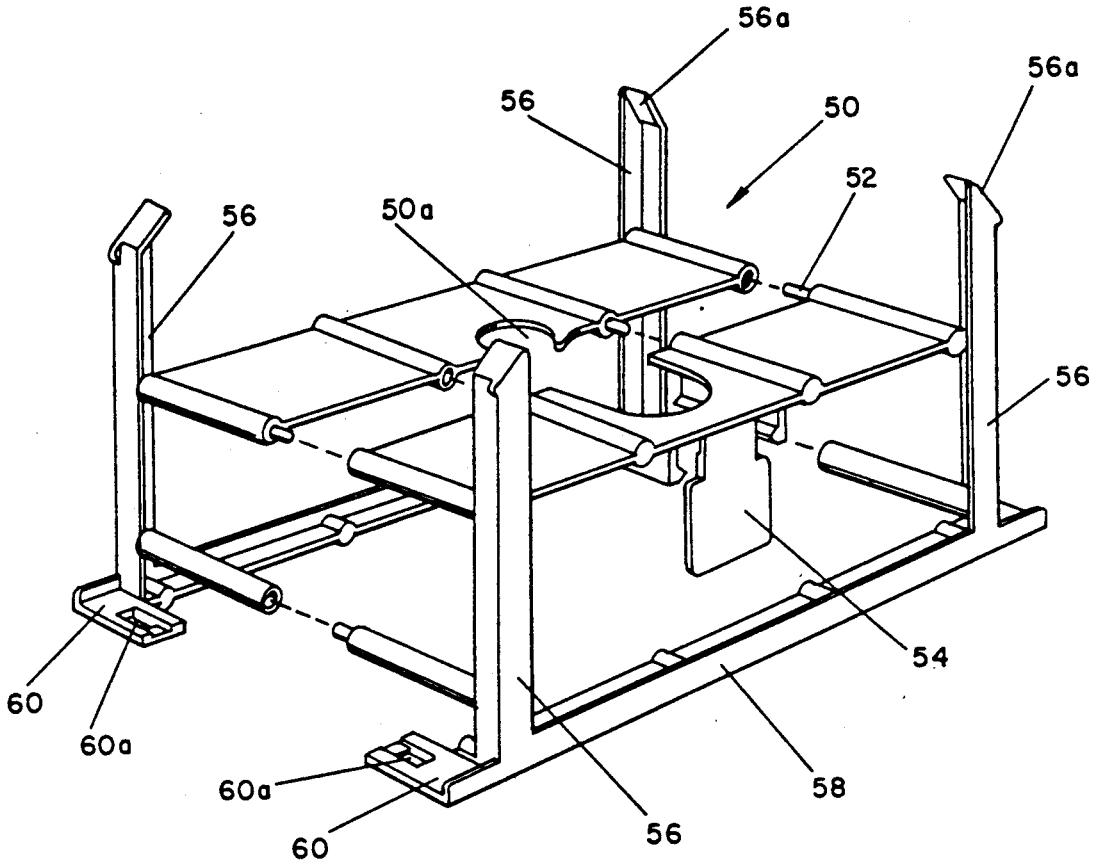
FIG — 7 PRIOR ART
FIG. 7 is an illustration of an electric luminaria fixture known in the prior art.

Turning now to FIG. 7, the prior art fixture shown therein is characterized by a two-piece frame 50. The two halves of the frame must be connected during assembly by pins 52, which tend to break with extended use. The frame 50 has no provision for allowing light to radiate downwardly to the lower portion of the assembly. Consequently uniform illumination of the bag above and below the level of the frame is not obtained. Additionally, this prior art fixture utilizes an altogether different mechanism for retaining a lamp socket. A foldable tab 54 engages a socket placed in a socket hole 50*a*. However, the tab 54 has only a limited capability to adapt to sockets of different sizes and also tends to break off with extended use. Additionally, the prior art fixture does not include rotatable legs. It includes integral legs 56 which are connected at the bottoms by cross bars or rigid rails 58. The rails 58 do not accommodate rough or uneven surfaces as well as independent legs. The prior art fixture further includes fixed, nonrotatable feet 60, which include encircling nail slots 60*a* located immediately adjacent the legs 56 and frame 58 where they are difficult to access. Further, the legs 56 include sharply angular upper ends 56*a*, which do not facilitate sliding the fixture into a bag and sometimes tear the bags.

The present invention presents several improvements over such a prior art device. The one-piece construction of the instant invention together with the removable legs provides not only for ease of assembly, but offers more compact storage of a fixture which might be used only for festive or specific holiday occasions. Further, assembly of the frame of the present invention is easier because it consists of snapping together the components of frame and legs comprising a recess approximately the diameter of the leg, as opposed to snapping together the two-piece frame of the prior art device described above, using small integral pegs, which necessarily would be smaller in size, and require a certain degree of dexterity. In addition, the present invention provides flexibility of fastening the fixture to uneven surfaces. In the present invention, there are no cross members or rails connecting the legs, as in the prior art fixture, nor is the foot in a fixed position relative to the frame. Fastening tools such as hammers, staple guns or mallets, which typically would be used to secure such fixtures to a surface, may be used without risk of breaking the fixture of the instant invention. Further, the lamp securing structure of this invention offers increased flexibility as to varying sized lamps, without relying on the resilient life of the constructive material of the prior art fixture. Finally, when assembled and placed next to each other, the assembled luminaria of the prior art would not provide the amount of illumination of this invention, because of the light-blocking, solid construction of the prior art device. Presumably, more numerous or closely positioned prior art luminarias would be required for the same aesthetic appearance provided by the instant invention.

Although the invention has been described with reference to these preferred embodiments, other embodiments can achieve the same results. Variations and modifications of the present invention will be obvious to those skilled in the art and it is intended to cover in the appended claims all such modifications and equivalents.

We claim:

1. An electric luminaria fixture, for supporting an electric lamp within a fixture enclosing bag, comprising:

a generally planar frame sized to be positioned horizontally inside the bag, said frame comprising a central socket opening for supporting and retaining a lamp socket and socket clip means for retaining said lamp socket within said central socket opening, said socket clip means comprising an arcuate member pivotably mounted to said frame so as to swing horizontally over said socket opening, whereby said arcuate member is operable to retain said lamp socket within said central socket opening; and legs for supporting said frame so as to space said frame above an underlying supporting surface.

2. The electric luminaria fixture defined in claim 1 wherein said arcuate member is operable to encircle said lamp socket positioned within said central socket opening to retain said lamp socket within said central socket opening.

3. The electric luminaria fixture defined in claim 1 wherein said arcuate member is operable to urge said lamp socket against an opposite side of said central socket opening to retain said lamp socket within said central socket opening.

4. The electric luminaria fixture defined in claim 1 wherein said arcuate member comprises an integral pivot pin, said pivot pin being engaged in a cooperating bore formed in said frame adjacent said socket opening, and wherein said pivot pin is snugly fitted within said bore so as to provide frictional resistance to rotation, whereby said arcuate member is selectively positionable to retain said lamp socket in said central socket opening.

5. The electric luminaria fixture defined in claim 1 wherein said planar frame is a generally rectangular, one-piece frame.

6. The electric luminaria fixture defined in claim 1 wherein said legs are devoid of cross member means.

7. The electric luminaria fixture defined in claim 1 wherein said legs are removably attachable to said planar frame.

8. The electric luminaria fixture defined in claim 7 wherein said legs are snap fittable into recesses formed in said planar frame.

9. The electric luminaria fixture defined in claim 8 wherein said legs are generally cylindrical in cross section where snap fittable so as to be rotatable with respect to said planar frame.

10. The electric luminaria fixture defined in claim 1 wherein said legs comprise upright extensions which extend upwardly above said planar frame so as to stabilize the bag enclosing said planar frame and inhibit the bag from undergoing distortion.

11. The electric luminaria fixture defined in claim 10 wherein said upright extensions of said legs comprise rounded upper ends to ease guiding the bag onto said fixture and prevent tearing of the bag thereon.

12. The electric luminaria fixture defined in claim 1 wherein said legs comprise outwardly extendable feet.

13. The electric luminaria fixture defined in claim 12 wherein said feet comprise slot means for placement of fasteners to secure said legs to an underlying support surface.

14. The electric luminaria fixture defined in claim 13 wherein said slot means in said feet of said legs are positionable to face outwardly from said legs and frame to facilitate driving of fasteners into said slots.

15. The electric luminaria fixture defined in claim 1 wherein said legs comprise means for securing the bag to said legs.

16. The electric luminaria fixture defined in claim 15 wherein said bag securing means comprise integral clips on said legs for securing the bag to said legs.

17. The electric luminaria fixture defined in claim 1 wherein said planar frame further comprises a plurality of spaced openings to allow light radiated from a lamp mounted on said frame to illuminate said bag uniformly above the plane of said frame, to dissipate heat from said lamp, and to provide ease in assembly of said fixture.

18. An electric luminaria fixture, for supporting an electric lamp within a fixture enclosing bag, comprising:

a generally planar frame sized to be positioned horizontally inside the bag, said frame comprising a central socket opening for supporting and retaining a lamp socket and socket clip means for retaining said lamp socket within said central socket opening; and rotatable legs for supporting said frame so as to space said frame above a supporting surface, said legs being removably attachable to said planar frame, wherein said legs are snap fittable into recesses formed in said planar frame, and wherein said legs comprise bag stabilizing upright extensions which comprise rounded upper ends to ease guiding the bag onto said fixture and prevent tearing of the bag thereon.

19. The electric luminaria fixture defined in claim 18 wherein said legs are generally cylindrical in cross section where snap fittable so as to be rotatable with respect to said planar frame.

20. The electric luminaria fixture defined in claim 18 wherein said legs comprise outwardly extendable feet.

21. The electric luminaria fixture defined in claim 20 wherein said feet comprise slot means for placement of fasteners to secure said legs to an underlying support surface.

22. The electric luminaria fixture defined in claim 18 wherein said legs comprise means for securing the bag to said legs.

23. The electric luminaria fixture defined in claim 18 wherein said planar frame further comprises a plurality of spaced openings to allow light radiated from a lamp mounted on said frame to illuminate said bag uniformly above and below the plane of said frame, to dissipate heat from said lamp, and to provide ease in assembly of said fixture.

24. An electric luminaria fixture, for supporting an electric lamp within a fixture enclosing bag, comprising:

a generally planar frame sized to be positioned horizontally inside the bag, said frame comprising a central socket opening for supporting and retaining a lamp socket and socket clip means for retaining said lamp socket within said central socket opening; and rotatable legs for supporting said frame so as to space said frame above a supporting surface, said legs comprising upright extensions which extend upwardly above said planar frame so as to stabilize the bag enclosing said planar frame and prevent the bag from undergoing distortion, said upright extensions comprising rounded upper ends to ease guiding the bag onto said fixture and prevent tearing of the bag thereon.

25. The electric luminaria fixture defined in claim 24 wherein said legs comprise outwardly extendable feet.

26. The electric luminaria fixture defined in claim 24 wherein said legs comprise means for securing the bag to said legs.

27. The electric luminaria fixture defined in claim 24 wherein said planar frame further comprises a plurality of spaced openings to allow light radiated from a lamp mounted on said frame to illuminate said bag uniformly above and below the plane of said frame, to dissipate heat from said lamp, and to provide ease in assembly of said fixture.

28. An electric luminaria fixture, for supporting an electric lamp within a fixture enclosing bag, comprising:

a generally planar frame sized to be positioned horizontally inside the bag, said frame comprising a central socket opening for supporting and retaining a lamp socket and socket clip means for retaining said lamp socket within said central socket opening, wherein said planar frame further comprises a plurality of spaced openings to allow light radiated from a lamp mounted on said frame to illuminate said bag uniformly above and below the plane of said frame, to dissipate heat from said lamp, and to provide ease in assembly of said fixture; and rotatable legs for supporting said frame so as to space said frame above a supporting surface, said legs comprising integral outwardly extending feet.

29. The electric luminaria fixture defined in claim 28 wherein said feet comprise slot means for placement of fasteners to secure said legs to the underlying support surface.

30. The electric luminaria fixture defined in claim 29 wherein said slot means in said feet of said legs are positionable to face outwardly from said legs and frame to facilitate driving of fasteners into said slots.

31. The electric luminaria fixture defined in claim 28 wherein said legs comprise means for securing edges of the bag to said legs.

32. An electric luminaria fixture, for supporting an electric lamp within a fixture enclosing bag, comprising:

a generally planar frame sized to be positioned horizontally inside the bag, said frame comprising a central socket opening for supporting and retaining a lamp socket and socket clip means for retaining said lamp socket within said central socket opening; and rotatable legs for supporting said frame so as to space said frame above a supporting surface, said legs comprising means for securing the bag to said legs, and wherein said bag securing means comprises clips on said legs for securing the bag to said legs.

33. The electric luminaria fixture defined in claim 32 wherein said planar frame further comprises a plurality of spaced openings to allow light radiated from a lamp mounted on said frame to illuminate said bag uniformly above and below the plane of said frame, to dissipate heat from said lamp, and to provide ease in assembly of said fixture.

34. An electric luminaria fixture, for supporting an electric lamp within a bag, comprising:

a generally planar frame sized to be positioned horizontally inside the bag, said frame comprising a central socket opening for supporting and retaining a lamp socket and socket clip means for retaining said lamp socket within said central socket opening, and said frame further comprising a plurality of spaced openings to allow light radiated from a lamp mounted on said frame to illuminate said bag uniformly above and below the plane of said frame, to dissipate heat from said lamp, and to provide ease in assembly of said fixture; and rotatable legs for supporting said frame so as to space said frame above a supporting surface.

* * * * *